US005390818A

United States Patent [19]

LaBuda

[11] Patent Number: 5,390,818

[45] Date of Patent: Feb. 21, 1995

[54] RECEPTACLE FOR HOLDING TRASH LINER

[76] Inventor: Michele LaBuda, 3431 E. 4th St., Tucson, Ariz. 85716

[21] Appl. No.: 144,740

[22] Filed: Oct. 28, 1993

Related U.S. Application Data

[62] Division of Ser. No. 908,288, Jul. 2, 1992, Pat. No. 5,269,434.

[51] Int. Cl.[6] ..... B65D 90/34

[52] U.S. Cl. ..... 220/676; 141/390; 141/391; 220/908; 220/404

[58] Field of Search ..... 141/390, 391; 220/908, 220/404, 408, 410, 729, 676, 756

[56] References Cited

U.S. PATENT DOCUMENTS

| | | | |
|---|---|---|---|
| 190,512 | 5/1877 | Paulding | 220/908 |
| 642,409 | 1/1900 | Yancey | 220/908 |
| 1,131,774 | 3/1915 | Davis | 220/908 |
| 1,227,964 | 5/1917 | Shepperd | 220/908 |
| 1,558,128 | 10/1925 | Walsh | 220/908 |
| 2,949,209 | 8/1960 | Schott | 220/908 |
| 3,422,985 | 1/1969 | Rinehart | 220/404 |
| 3,595,507 | 7/1971 | Kurlander | 248/97 |
| 3,643,993 | 2/1972 | Asadurian | 220/908 |
| 3,927,786 | 12/1975 | Aboud | 220/4 R |
| 3,964,630 | 6/1976 | Getz | 220/63 R |
| 4,022,257 | 5/1977 | O'Connell | 141/391 |
| 4,054,225 | 10/1977 | Frech | 220/63 R |
| 4,140,257 | 2/1979 | Peterson | 224/49 |
| 4,254,602 | 3/1981 | Boynton . | |
| 4,294,379 | 10/1981 | Bard | 220/404 |
| 4,300,696 | 11/1981 | Bryce | 220/908 |
| 4,363,417 | 12/1982 | Rhoades | 220/908 |
| 4,416,197 | 11/1983 | Kenl | 100/214 |
| 4,434,810 | 3/1984 | Atkinson | 137/493 |
| 4,440,321 | 4/1984 | Campbell | 222/153 |
| 4,458,584 | 7/1984 | Annese et al. | 220/521 |
| 4,643,380 | 2/1987 | Copeland | 248/97 |
| 4,666,054 | 5/1987 | Jaicks | 220/908 |
| 4,890,760 | 1/1990 | Nicoll, Sr. et al. | 220/908 |
| 4,913,308 | 4/1990 | Culbertson | 220/908 |
| 4,923,080 | 5/1990 | Lounsbury | 220/66 |
| 4,930,653 | 6/1990 | Machado | 220/908 |
| 4,951,831 | 8/1990 | Roesch | 220/1 T |
| 4,953,740 | 9/1990 | Koda | 220/908 |
| 4,972,966 | 11/1990 | Craft | 220/908 |
| 5,105,972 | 4/1992 | Waterston | 220/404 |
| 5,147,055 | 9/1992 | Samson | 220/908 |
| 5,163,579 | 11/1992 | Jones | 220/908 |

*Primary Examiner*—S. Castellano

*Attorney, Agent, or Firm*—Oldham, Oldham, & Wilson Co.

[57] ABSTRACT

An apparatus for receiving and holding a flexible and collapsible trash liner comprises a rigid upright trash receptacle having a main body with a generally closed bottom and an open top. The bottom has a periphery about which the bottom is affixed to the main body, and this periphery has at least one cavity formed therealong. The cavity effectively forms a foothold for a user in removing the trash liner from the receptacle as well as a handhold for a user in transporting the trash receptacle.

13 Claims, 3 Drawing Sheets

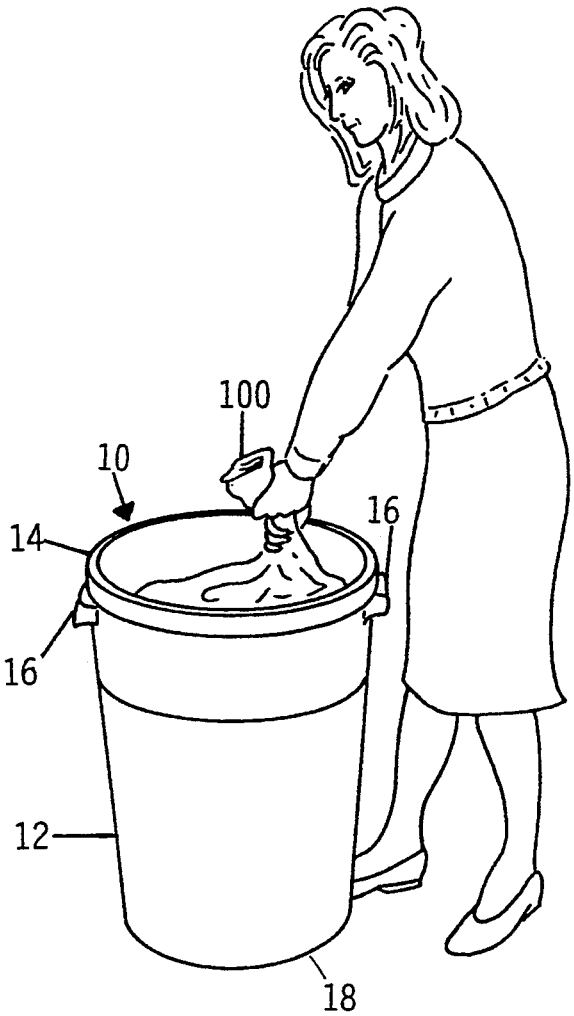
FIG.-1
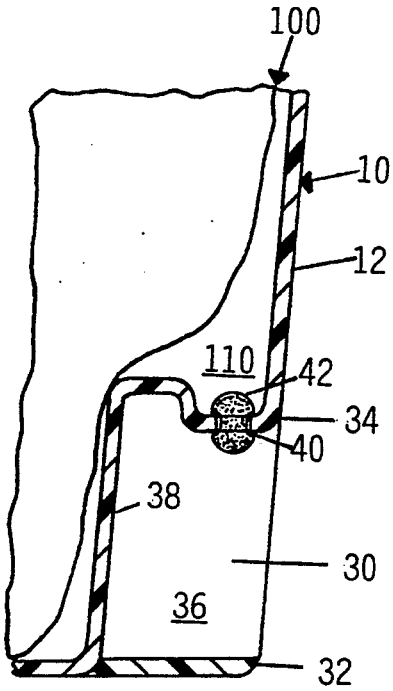
FIG.-2
FIG.-3
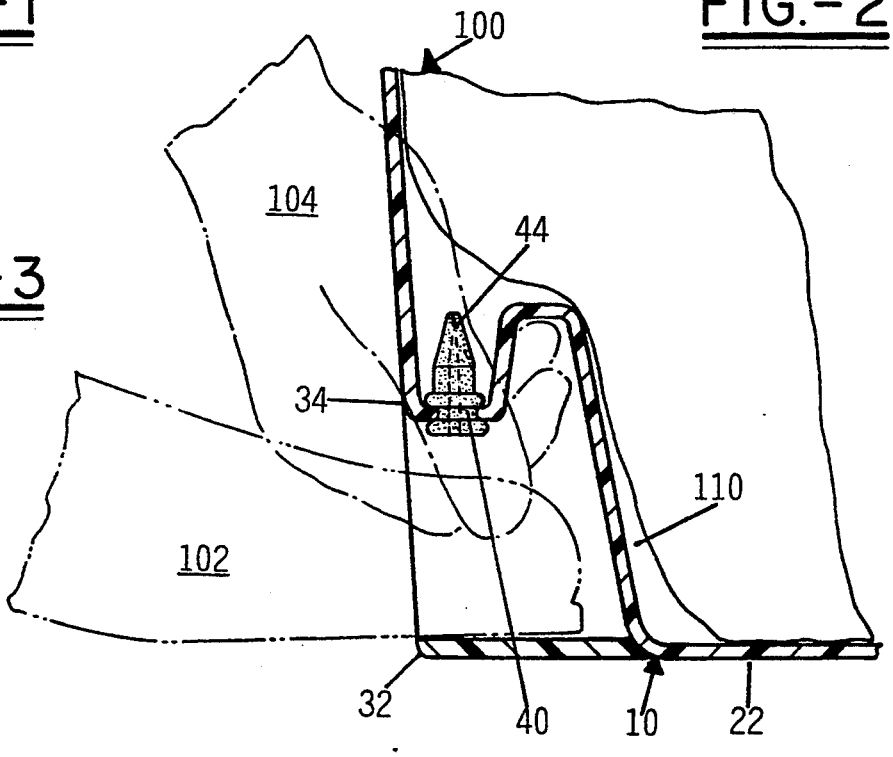

RECEPTACLE FOR HOLDING TRASH LINER

This is a divisional of application Ser. No. 07/908,288, filed on Jul. 2, 1992, now U.S. Pat. No. 5,269,434.

The present invention relates to a trash receptacle for receiving and holding a flexible, collapsible trash liner. More particularly, it relates to such a trash receptacle having at least one cavity formed in the lower portion of the trash receptacle, so that the cavity provide both a foothold for assisting a user in removing a full trash liner from the receptacle and a handhold to assist the user in transporting the receptacle.

BACKGROUND ART

There are a variety of trash receptacles taught in the prior art. These are best understood in light of the problems presented by the trash liners of the prior art.

Within the last generation, trash liners that are flexible and collapsible and made from thin plastic film (usually polyethylene) have displaced paper bags, particularly Kraft-type paper bags, as the preferred method of trash disposal. Although they present the advantages of being moistureproof, sealable to prevent the escape of malodorous emanations, and less expensive, the plastic film trash liners are so flexible that they are structurally incapable of supporting themselves in an upright and open position when empty. As a result, the trash liner must be contained within a support structure. Because the liner is so thin, the support structure must not present puncture points which might penetrate the liner. The liners are often used in receptacles with a volume of 20 gallons or more. If the liner is filled to a density of even 10 lbs/ft$^3$ (about one-sixth the density of water), the liner could weigh almost 27 lbs. When fully expanded within the receptacle, the trash liner will contour itself closely to the interior surface of the receptacle. As the liner is removed from the receptacle, the close fit around the interior circumference is so good that, unless there are internal structures in the receptacle to allow air to flow past the receptacle-liner interface, the liner will act as a piston within a cylinder, and the vacuum created between the trash liner and the receptacle will increase the difficulty in removing the liner. In addition to increasing the difficulty of removal, this increases the probability of tearing the thin liner walls.

Several inventors have suggested their solution to these problems in their patents. For example, U.S. Pat. No. 3,595,507 to Kurlander (Jul. 27, 1971) teaches a rather simple frame composed of rod members that holds the trash liner open and constricts the liner within a generally cylindrical volume.

Aboud, in U.S. Pat. No. 3,927,786 (Dec. 23, 1975), teaches an upright two-piece container that allows the main tubular body of the container to be lifted from the bottom portion. When the trash liner is full, the user removes the container from the trash liner rather than vice versa.

Getz, U.S. Pat. No. 3,964,630 (Jun. 22, 1976), has a container where the filled, closed trash liner is removed by opening the container, the top portion of which is hingedly connected to the bottom portion. The cross-section of the intermediate portion of the container decreases from bottom to top, so that the tendency of the liner to bind to the container is minimized as the hinged intermediate portion is swung off of the bottom portion.

In U.S. Pat. No. 4,054,225 (Oct. 18, 1977), Frech teaches a container where the cylindrical container has a continuous longitudinal slit therealong, with latching means provided on either side of the slit. The filled liner is released from the container by opening the latching means, effectively increasing the container volume.

Peterson, in U.S. Pat. No. 4,140,257 (Feb. 20, 1979), attacks the problem by using a sling that is placed in a conventional container before the trash liner. The webs of the sling are attached to each other once the trash liner is filled, and they provide additional strength to the trash liner, as well as lifting the liner away from the container walls.

Boynton, U.S. Pat. No. 4,254,602 (Mar. 10, 1981), teaches a device that compacts the trash into a plug that is somewhat smaller than the trash liner. This device is then inserted into the trash liner, rather than vice versa, and the transfer from device to liner is accomplished.

In U.S. Pat. No. 4,294,379 (Oct. 13, 1981), Bard teaches a container with internally positioned vertical tubes to allow air to flow to the vacant space below the trash liner to assist in removing the trash liner from the container.

Kehl, in U.S. Pat. No. 4,416,197 (Nov. 22, 1983), teaches a container for allowing compaction of trash within a trash liner. The container has apertures to allow air to be expelled from the space between the liner and the container. The container is also equipped with a circumferential recess or a flange near or at the bottom surface of the container to allow a foothold in filling the liner or removing it from the container.

Campbell, U.S. Pat. No. 4,440,321 (Apr. 3, 1984), adapts the concept of Boynton '602 by designing a container that is filled with trash which is compacted therein before the trash is deposited in a trash liner that fits over rather than within the container.

Copeland, U.S. Pat. 4,643,380 (Feb. 17, 1987), teaches a container in the style of Aboud '786; that is, the container is removed from the filled trash liner rather than vice versa.

Lounsbury teaches a trash receptacle that opens on the side so that the filed bag need not be lifted out of the receptacle, in U.S. Pat. No. 4,923,080 (May 8, 1990).

Roesch, U.S. Pat. No. 4,951,831 (Aug. 28, 1990), teaches a plastic trash receptacle that has a plurality of longitudinal slots, as opposed to the single longitudinal slit of Frech. Also, the slots do not extend completely to the top end of the container. Roesch teaches the use of outwardly extending toe holds to assist in removing the liner from the receptacle.

SUMMARY OF THE INVENTION

It is a first object of the invention to provide a rigid receptacle for housing and supporting a trash liner while the liner is being filled.

The receptacle should minimize the escape of odors, liquids and the like from the trash being held in the liner. This should be accomplished by presenting minimal opportunity for puncture of the liner and by providing positive containment for whatever odor or liquid that does escape within the receptacle.

The receptacle should afford easy removal of the filled trash liner.

The receptacle should be attractive for use in the home.

These and other objects of the present invention are achieved by an apparatus for receiving and holding a flexible and collapsible trash liner which comprises a rigid upright trash receptacle with a main body having a generally closed bottom and an open top. The bottom has a periphery about it that is affixed to said main body, and this periphery has at least one cavity formed therealong, effectively forming a foothold for a user in removing said trash liner from the receptacle and a handhold for a user in transporting the trash receptacle. In one particular embodiment, there are at least two such cavities, which are preferentially symmetrically arranged about the periphery. The receptacle is preferred to be molded from a thermoplastic material, particularly the group consisting of polyethylene, polypropylene, poly(oxymethylene) and polyamide. In a preferred embodiment, at least one cavity has at least one aperture through it, thereby communicating the interior of the receptacle with the exterior thereof. In an especially preferred embodiment, this aperture is fitted with a means for allowing air to enter the interior of the receptacle while retaining liquid in the interior, and this means should also allow air flow into the interior of the receptacle only when there is a lower pressure in the interior than on the exterior. The cavity may be formed by integral molding of the cavity into the receptacle body or it may be formed by affixing a further piece of material to the receptacle body, the separate piece constituting the foothold portion. In one embodiment, the cavity extends around the entire periphery of the bottom.

Even further objects are achieved by a method of removing a trash liner from a trash receptacle having at least one cavity as described above and wherein the method comprises the steps of: inserting a foot of the user radially into the cavity so that the user is positioned with his or her center of gravity more directly above the trash liner than is possible when the user's feet are tangentially positioned to the receptacle bottom; grasping the top of the trash liner; lifting the trash liner, thereby creating a lower air pressure in the space between the liner and the interior surface of the receptacle and allowing air to flow into that space; and removing the trash liner from the receptacle.

BRIEF DESCRIPTION OF THE DRAWINGS

The invention will be better understood and objects of the invention even beyond those set forth above will be apparent when consideration is given to the following detailed description. Such description makes reference to the accompanying drawings, wherein identical reference numerals indicate identical parts, and wherein:

FIG. 1 is an environmental view illustrating the use of the present invention in removing a trash liner from the present invention receptacle;

FIG. 2 is an elevational view, in cross-section, of a portion of the present invention trash receptacle as may be taken at the bottom end thereof and illustrating the novel cavity feature;

FIG. 3 is an elevational view, in cross-section and similar to FIG. 2, further illustrating the manner of use of the present invention;

DETAILED DESCRIPTION OF HE DRAWINGS

Figure 4:
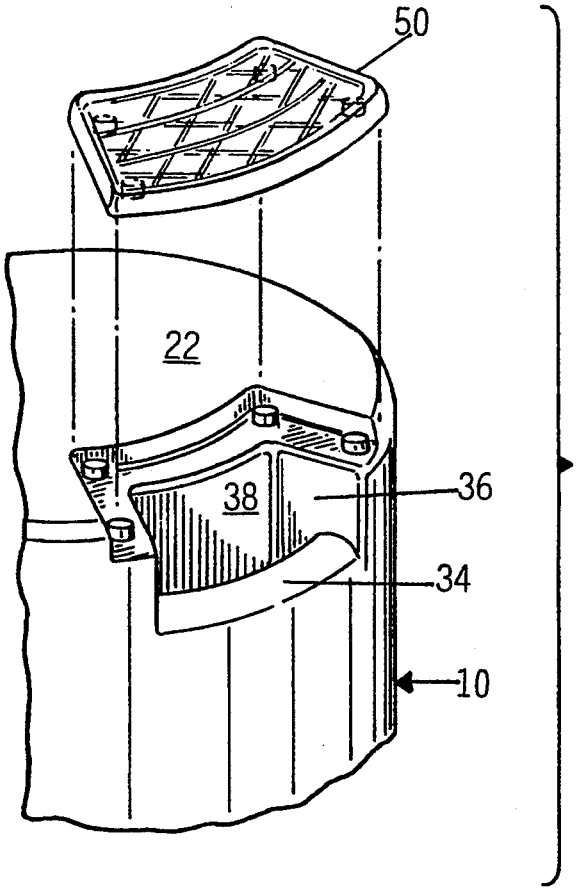
FIG. 4 is an exploded view, in perspective, as may be taken of the bottom end of an inverted trash receptacle as shown in FIG. 1 and illustrating a first embodiment of the invention.

FIG. 1 shows the trash receptacle 10 of the present invention in a perspective view. The overall appearance of the trash receptacle 10 is not strikingly different than the overall appearance of the trash receptacles known in the prior art.

The receptacle 10 comprises a rigid generally upright main body 12 that is preferably cylindrical in shape, although the main body 12 could easily be any of a variety of shapes, including elliptical, square, rectangular, hexagonal, or the like. The receptacle 10 has a generally open top 14, the periphery thereof being rolled outwardly or flanged so as to give rigidity to the peripheral surface, as well as to provide a ledge over which a trash liner 100 as known in the prior art may be placed. The sides of the main body 12 may be smooth (as shown in FIG. 1) or they may be somewhat ribbed as is also known in the prior art, the ribbing tending to give additional functional rigidity to the main body without increasing its thickness. There are preferably one or more handles 16 symmetrically placed around the circumference of the main body 14 towards the top portion to assist a user in lifting and carrying the receptacle 10 while it still has a trash liner 100 placed inside of it. The main body 12 clearly distinguishes the interior portion of the trash receptacle 10 from the exterior portion of the receptacle.

Figure 5:
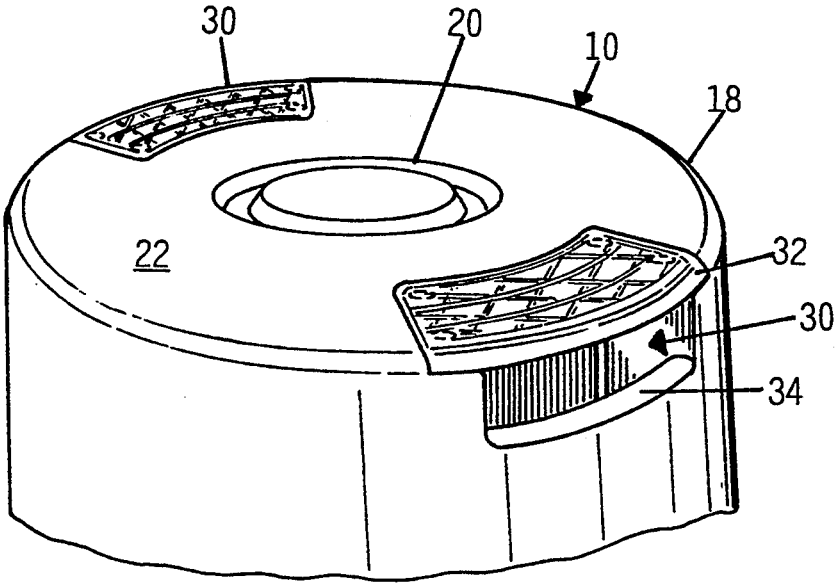
FIG. 5 is an assembled bottom perspective view of the trash receptacle shown in FIG. 4.

At the bottom end 18 of the trash receptacle 10, the receptacle is generally closed, as is known in the prior art. Referring now to FIG. 5, which shows a perspective view of an inverted receptacle 10 of the present invention, it is common, as is known in the prior art, to place concentric ribbing 20 or the like on the bottom surface 22, again for the purpose of increasing structural rigidity of the receptacle 10 without increasing the amount or weight of material used in constructing it. This interest in increasing structural rigidity while minimizing the amount of material used in construction has direct consequences in fabrication cost and is quite important for the economics of this product. This is, however, no different than the trash receptacles of the prior art.

Generally, the trash receptacle 10 of the present invention will be slightly frustoconical in shape, with the smaller end being at the bottom 18. In other words, rather than being a right cylinder, the bottom 18 will be smaller in diameter than the top 14. This is for several reasons, including ease in removing the trash can liner 100 from the receptacle 10 as well as ease in removing the receptacle from the mold during the manufacturing process.

Figure 6:
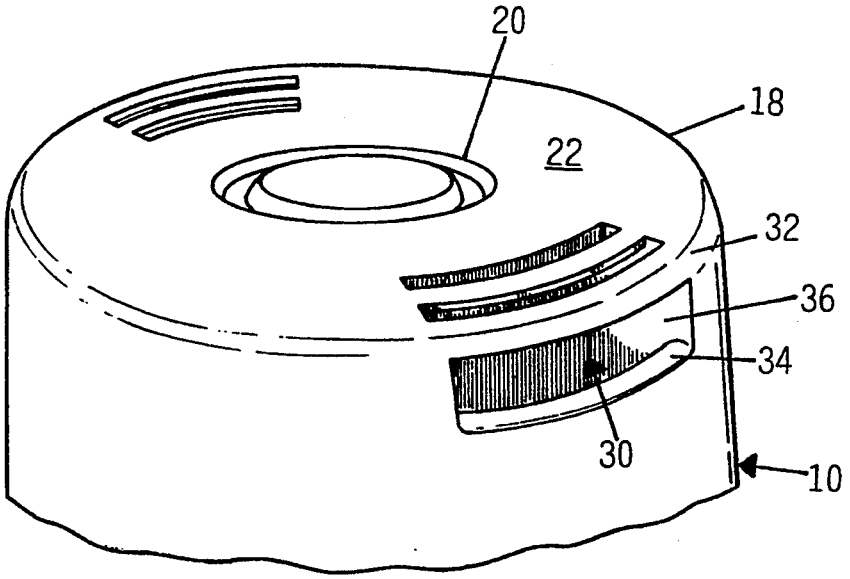
FIG. 6 is a bottom perspective view of a second embodiment of the trash receptacle shown in FIG. 1.
Figure 7:
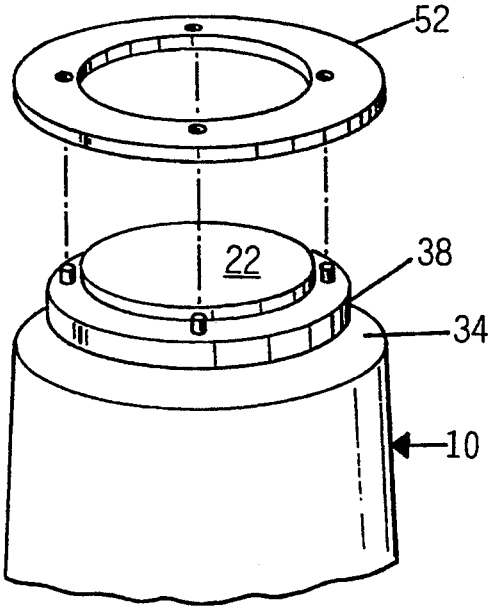
FIG. 7 is an exploded view, in perspective and similar to FIG. 4, of a third embodiment of the invention.

Attention is now directed to FIG. 5 which shows a perspective view of an inverted trash receptacle 10 of the present invention. As illustrated in FIG. 5, there are a pair of diametrically opposed cavities 30 formed along the periphery of the bottom surface 22. While only two cavities 30 are shown in FIG. 5, it is clear that three or more could easily be symmetrically positioned. Similarly, FIGS. 1 and 7 shows embodiments where only one cavity 30 is formed. In FIG. 1, a single cavity 30 such as shown in FIG. 5 or FIG. 6 is used by the user.

In FIG. 7, an embodiment is shown where the cavity 30 is formed around the entire bottom surface 22 so that the entire bottom periphery is able to function as the cavity 30.

The cavity 30 has two purposes. First, it provides a foothold on its lower portion 32 so that a user of the trash receptacle 10, who is attempting to remove a filled trash liner 100 from the receptacle can place a good portion of the length of his or her foot radially into the cavity 30 and thereby gain a point of leverage in lifting the trash liner out of the receptacle. This type of use is illustrated in FIG. 1, as well as FIG. 3, where the placement of a user's foot 102 into the cavity 30 is shown in phantom lines.

The cavity's second purpose is to provide, on its upper portion 34, a handhold that is useful in raising a filled receptacle 100 up to shoulder level, for example, to enable the user to dump the contents of the receptacle 10 into a larger trash container, if that is desired. The use of the upper portion 34 of the cavity 30 as a handhold is also illustrated in FIG. 3, where the placement of a user's hand 104 into the cavity is shown in phantom lines.

There are two particular advantages of the handhold-/foothold-type cavity 30 as taught in the present invention that clearly distinguish it from the prior art. First, the most commonly encountered footholds either extend outwardly from the receptacle, as taught in Roesch '831, or they extend circumferentially around the bottom periphery, as in Kehl '197. In the first instance, the outwardly extending foothold presents difficulties in molding and usually results in a placement of the user's foot so that the length of the foot is generally tangential to the bottom periphery. The second instance clearly mandates such a tangential placement of the user's foot. The present invention receptacle 10, with its cavity 30 foothold, encourages the user to position his or her foot so that its length is generally radial to the cylindrical receptacle 10. In fact, the embodiments shown in FIGS. 5 and 6 require the radial placement, since the sidewalls 36 of the cavity 30 preclude tangential placement, as does the fact that the lower portion 32 does not extend outwardly from the bottom periphery of the receptacle. This positioning inherently places the user's center of gravity closer to the center of gravity of the trash liner and reduces the strain involved in lifting a heavy trash liner. Fortuitously, this placement of the center of gravity above the radially placed foot also exerts the entire weight of the user onto the foothold, which is much more effective than the tangential type of foothold, where the user's weight is exerted angularly through the splayed legs.

The second advantage taught of the cavity 30 is the placement of the handhold on the top portion 34 of the cavity, a few inches above the bottom periphery 18 of the receptacle. When a handhold is provided along the bottom periphery, it is necessary for a user to tilt the receptacle slightly in order to insert the fingers under the handhold. This presents at least a pinch point, and possibly even a potential for severe damage to the hand. The cavity 30 as taught in the present invention allows the handhold to be grasped without having to lift the receptacle 10 at all. In fact, the overall cavity structure, with the sidewalls 36, the interior wall 38 and the lower portion 32, tends to shield the hand while it is engaged upon the handhold, thereby providing safety far beyond that available in the prior art. It is also believed that the handhold taught in the present invention is more appropriately called a "handhold" than some of those known in the prior art, which are really "fingerholds." This is due to the depth of the cavity provided by the interior wall 38, as well illustrated in FIG. 2.

One of the problems of trash receptacles of the prior art is the creation of a vacuum at the receptacle's lower interior portion (generally shown as 110 in FIG. 2) when the user removes a trash liner 100 from the receptacle, particularly when the trash liner is so completely filled that the trash liner 100 is pressed against the main body interior walls of the receptacle. This problem is especially pronounced when the trash liner 100 has any appreciable amount of liquid therein, as its mobility allows an even closer conformance with the interior wall.

As shown in FIG. 2 and 3, the solution provided by the present invention receptacle 10 is to position at least one aperture 40 at the cavity through the wall so that there is a communication between the interior and exterior of the receptacle. Then, as one withdraws the trash liner 100 from the receptacle, the vacuum that would have been formed with the receptacle of the prior art is not formed, since air is drawn into the interior 110 of the receptacle through the aperture 40 and removal of the liner is not impeded. In one embodiment of the present invention, the aperture 40 would be a simple hole that permits easy flow of air, liquids or the like in either direction. In another embodiment of the present invention, a means for selectively permitting flow in one direction is used. One such means would involve a simple flapper type valve 42, as shown in FIG. 2. Another such means would be a "duckbill" type valve 44, as shown in FIG. 3. Other equivalents of these types of valves are also known and readily accessible to one of skill in designing such systems. These types of devices are such that they minimize or eliminate flow in a first direction, while allowing flow in the opposite direction as soon as some pressure differential is introduced between the first side and the second side. In this particular case, the attempt to remove the trash liner 100 from the receptacle 10 will induce a lowered air pressure on the receptacle interior 110, inducing flow through the aperture 40 and/or valve means 42 or 44 and allowing air to pass into the interior.

While not critical to the operation of the present invention, it is noted that the preferred position for the valve means 42 would seem to be as shown in FIGS. 2 or 3, so that the upper portion 34, acting as a fingerhold, also protects the valve means 42 from being a puncture point for the trash liner 100. This is shown in FIGS. 2 and 3.

There are several methods in which the cavity 30 may be formed in the receptacle 10 of the present invention. In the most preferred methods of forming the receptacle 10, it will be manufactured from a thermoplastic material in a conventional molding process such as injection molding, rotational molding or the like. Specific materials that would be preferred in manufacturing such a receptacle 10 would include polyethylenes, particularly the high density polyethylenes, polypropylene, poly(oxymethylene), and possibly even polyamide. Because the trash receptacle 10 is one that is not Subjected to large stresses and the like, it may well be possible to use a previously processed or otherwise recycled material in forming the trash receptacle. Also, since it is not necessary that the receptacle be transparent or even translucent, the use of a pre-processed material with additional stabilizers or antioxidants would not be precluded.

The cavity 30 with its distinctive lower portion 32 foothold and upper portion 34 handhold may be integrally formed with the receptacle 10 itself during the molding process, or it may be separately molded and affixed to the receptacle through a variety of means, including thermowelding of the footholds. Likewise, the footholds may be the same material, particularly if integral molding is done. If an attachment process is used to affix the foothold, the foothold may be formed of another material, preferably a slightly more rigid material. It would also be noted that in such a case, it may be preferable to have a series of structural ribs on either the upper or lower side, or both, of the foothold, to provide additional rigidity to this piece. Referring now to FIGS. 4 and 5, the affixation of a separately formed plate 50 to the conventionally molded cavity lacking a lower portion 32 is illustrated. Similarly, FIG. 7 shows the attachment of a separately formed annular plate 52 to the bottom of a molded receptacle, so that a completely circumferential cavity lacking the sidewall feature is formed.

A cavity 30 as taught in the present invention may also be integrally molded into the receptacle ].0, as shown in FIG. 6. These methods of forming the cavity 30 into the receptacle are taught to comply with the requirements of the patent law, and are not intended as limitations of the methods of forming the cavity 30, which may be formed in other manners.

The method of removing a trash liner 100 from a trash receptacle 10 having at least one cavity 30 as taught herein comprises the steps of: 1) the user inserts a foot radially into the cavity 30 so that the user is positioned with his or her center of gravity more directly above the trash liner 100 than is possible when the user's feet are positioned tangentially to the receptacle bottom; 2) the user grasps the top of the trash liner 100 with his or her hands; 3) the user lifts the trash liner 100, thereby creating a lower air pressure in the space 110 between the liner 100 and the interior surface of the receptacle; and 5) the aperture 40 and/or the means 42 for selectively allowing air to flow into the space 110 allows the air pressure below the trash liner to equalize with the exterior air pressure; and 6) the user removes the trash liner from the receptacle.

While in accordance with the paten statutes, the best mode and preferred embodiment of the invention have been described, it is to be understood that the invention is not limited thereto, but rather is to be measured by the scope and spirit of the appended claims.

What is claimed is:

1. An apparatus for receiving and holding a flexible and collapsible trash liner comprising:

a rigid upright trash receptacle having an upwardly extending main body with a generally closed bottom and an open top, said receptacle resting on an underside surface of said bottom, said bottom having a periphery about which said bottom is affixed to said main body;

said periphery having integrally molded therealong at least one sidewardly open cavity, said at least one sidewardly open cavity extending upwardly from the underside surface to extend into a portion of said main body, wherein the underside surface and each said at least one sidewardly open cavity effectively form a foothold for a user in removing said trash liner from said receptacle and a handhold for said user in transporting said trash receptacle; and wherein at least one said at least one sidewardly open cavity has an aperture therethrough communicating the interior of said receptacle with the exterior thereof, said aperture having inserted therein a means for allowing air to enter the interior of the receptacle while retaining liquid in the interior, wherein the means for allowing air to enter the interior of the receptacle allows air flow only when there is a lower pressure in the interior of the receptacle than on the exterior and restricts air flow when there is a higher pressure in the interior of the receptacle than on the exterior.

2. The apparatus of claim 1, wherein said at least one cavity comprises at least two cavities, symmetrically positioned.

3. The apparatus of claim 1 wherein the trash receptacle is molded from a thermoplastic material.

4. The apparatus of claim 3 wherein the plastic material is selected from the group consisting of polyethylene, polypropylene, poly(oxymethylene) and polyamide.

5. The apparatus of claim 1 wherein the means for allowing air is a flapper type valve.

6. The apparatus of claim 1 wherein the means for allowing air is a duckbill type valve.

7. An apparatus for receiving and holding a flexible and collapsible trash liner comprising:

a rigid upright trash receptacle having an upwardly extending main body with a generally closed bottom and an open top, said receptacle resting on an underside surface of said bottom, said bottom having a periphery about which said bottom is affixed to said main body;

said periphery also having formed therealong at least one cavity, each said at least one cavity effectively forming a foothold for a user in removing said trash liner from said receptacle and a handhold for said user in transporting said trash receptacle; and an aperture communicating the interior of sad receptacle with the exterior thereof, said aperture located in at least one said at least one cavity and having inserted therein a means for allowing air to enter the interior of the receptacle while retaining liquid in the interior, wherein the means for allowing air to enter the interior of the receptacle allows air flow only when there is a lower pressure in the interior of the receptacle than on the exterior and restricts air flow when there is a higher pressure in the interior of the receptacle than on the exterior.

8. The apparatus of claim 7 wherein said at least one cavity comprises at least two cavities, symmetrically positioned.

9. The apparatus of claim 7 wherein the trash receptacle is molded from a thermoplastic material.

10. The apparatus of claim 9 wherein the plastic material is selected from the group consisting of polyethylene, polypropylene, poly(oxymethylene) and polyamide.

11. The apparatus of claim 7 wherein the means for allowing air is a flapper type valve.

12. The apparatus of claim 7 wherein the means for allowing air is a duckbill type valve.

13. The apparatus of claim 7 wherein the aperture is located on an inner upper surface of said at least one cavity.

* * * * *